United States Patent [19]

Pyle

[11] 4,245,925

[45] Jan. 20, 1981

[54] EXPANSION JOINT SEALING APPARATUS AND METHOD FOR SEALING SAME

[75] Inventor: Lawrence F. Pyle, Deerfield, Ill.

[73] Assignee: Felt Products Mfg. Co., Skokie, Ill.

[21] Appl. No.: 972,909

[22] Filed: Dec. 26, 1978

[51] Int. Cl.[3] ..... E01C 11/04

[52] U.S. Cl. ..... 404/72; 14/16.5; 52/396; 404/69

[58] Field of Search ..... 404/69, 74, 68, 72, 404/65, 47, 48; 14/16.5; 52/396, 403

[56] References Cited

U.S. PATENT DOCUMENTS

| | | | |
|---|---|---|---|
| 2,246,903 | 6/1941 | Spears | 404/48 |
| 2,321,873 | 6/1943 | Tate | 404/47 X |
| 3,363,383 | 1/1968 | La Barge | 404/68 X |
| 3,570,378 | 3/1971 | Honegger | 404/69 |
| 3,690,226 | 9/1972 | Hein | 404/68 |
| 3,713,368 | 1/1973 | McDowell | 404/69 |
| 3,888,599 | 6/1975 | Reifsnyder | 404/69 |
| 3,981,601 | 9/1976 | Arai | 404/68 |

*Primary Examiner*—Nile C. Byers, Jr.
*Attorney, Agent, or Firm*—Dressler, Goldsmith, Shore, Sutker & Milnamow, Ltd.

[57] ABSTRACT

A sealing system and method for sealing an expansion joint in a roadway gap. Channel-shaped members are mounted at each side of the joint. A seal having a bead at each side is sealingly clamped by a retainer bar against the channel member to provide a seal across the roadway gap. The retainer bar is maintained in a clamping position against the seal bead by retainer plates and by a keeper pin which overlies the bar. The bar is forced downwardly into sealing engagement with the bead to permit positioning of the keeper pin over the retainer bar to hold it in clamping and sealing engagement.

15 Claims, 11 Drawing Figures

EXPANSION JOINT SEALING APPARATUS AND METHOD FOR SEALING SAME

BACKGROUND OF THE INVENTION

This invention relates to an improved expansion joint system for sealing roadway gaps between adjacent roadway slabs. It also relates to an improved method for installing an expansion joint sealing system and for inserting and replacing a sealing gland or membrane.

The sealing of roadway gaps has become increasingly important and is increasingly required by bridge engineers. Although it has always been important to provide bridge gap spanning devices for purposes of enabling traffic to cross expansion joints, in recent times the advantages and importance of overall bridge deck water-proofing and the sealing of gaps against the passage of water and debris has been recognized, especially in those geographic areas in which deicing chemicals and salts are widely used to assist in providing bare pavements during the winter months. The amount of damage which salts and the like have done to bridges and the tremendous maintenance costs and potential danger to life and property is now becoming fully apparent.

A wide variety of devices has been developed in the past for effecting the sealing of roadway gaps. These range from compression seals disposed in the gaps between slab sections to various kinds of sophisticated and sometimes complex structures which have been suggested for use. Among the expansion joint sealing devices which have been suggested for use are those shown in U.S. Pat. Nos. 3,626,822; 3,331,294; 3,570,378; and 3,981,601. Other sealing devices suggested for use are waterstops of the type shown in U.S. Pat. No. 2,246,903, and devices of the types shown in Koester, Expansion Joints, *Transatlantic Arts,* Inc., 1969 at pages 22–39 and 296. Systems based on these and related devices have met with varying degrees of success. Yet another type of sealing system is disclosed in U.S. Pat. No. 4,111,583 owned by the present assignee.

The need remains, however, for improved devices of the type generally typified by the sealing system disclosed in U.S. Pat. No. 4,111,583. To that end, the devices of the present invention provide enhanced sealing capability, together with ease of installation, ease of replacement and lesser cost. Devices of the present invention also make it possible to seal an expansion joint without exposing the fastening devices to vehicle and snowplow impacts.

SUMMARY OF THE INVENTION

The sealing system of the present invention includes a pair of retainer assemblies adapted to be provided and mounted, one at each side of a roadway gap. The retainer assemblies are adapted to be mounted at or below the roadway level or surface and to sealingly grip and retain a continuous elastomeric seal member or gland extending along the length of the gap. The retainer assemblies sealingly engage the seal member at each side of the gap, thereby to seal the gap against the passage of debris, chemicals and water therebelow.

The seal member itself is secured to the retainer assemblies below the roadway surface and without direct exposure of the retaining means to roadway traffic, to snowplow blades or the like. As such, the tendency of traffic loading and impacts to disturb or destroy the seal is minimized.

Preferably, the seal comprises a central arched main body portion having a pair of longitudinally extending legs, each diverging downwardly from the central main body portion. Each leg terminates at its side in a protrusion or bead. The seal preferably embeds at least one fabric reinforcement layer which extends from bead to bead to stiffen, rigidify and strengthen the seal means and the beads, although the seal may embed two or more reinforcing layers. However, because there is no direct traffic impact on the seal, it is possible to use a seal which is not reinforced. As such, an extruded seal rather than a molded seal may be used.

The retainer assemblies preferably comprise a form, such as a U-shaped channel, and a retainer bar slidably mounted on the form for slidable movement from a first position to a second seal bead clamping position. Means for retaining and guiding the retainer bar for movement between the first and second positions are provided. The retaining means may comprise retainer plates which, with the associated channel, define aligned apertures for receiving and holding an elongate retainer member, such as a keeper pin, for engaging the retainer bar to hold it in a position in which it clamps the seal bead between the retainer bar and a portion of the channel. The keeper pins are easily insertable and removable to facilitate substitution of seals if that becomes necessary at some time after the initial installation of the sealing system.

The sealing system of the present invention is easy to install and permits rapid replacement of the seal members if and when that becomes necessary.

In accordance with the method of this invention, retainer assemblies are positioned and installed at each side of the gap. Each of the retainer assemblies comprises a form, such as the U-shaped channel, and the associated slidably mounted retainer bar. A retainer means, such as a retainer plate, is mounted in association with the channel for guiding the retainer bar for sliding movement from a first position to a second clamping position in which the seal member is clampingly sealed at each side to one of the retainer assemblies.

After the retaining assembles are installed appropriately, the seal member is disposed with a portion at each side between a retainer bar and an associated confronting portion of the channel form or channel. Preferably, the seal portion is a bead adapted to be compressed between the retainer bar and a leg of the channel. The retainer bar is then forced from a first position toward the confronting channel leg to compress the bead therebetween. Preferably, a tool is used to so compress the seal portion and, in a preferred form, the tool acts agaist the upper surface of a retainer bar and an overlying leg of the channel. When the retainer bar is forced downwardly to compress the seal bead, a keeper means, such as a keeper pin, is passed through the retainer plate and an aligned aperture in the channel web to overlie the retainer bar. The tool is then moved to allow the retainer bar to move toward the first position. The pin prevents the retainer bar from returning fully to the first position. In that position the pin maintains the retainer bar in clamping and sealing engagement with the bead, and to a predetermined extent.

A plurality of aligned pairs of apertures are provided in retainer plates and in the channel and the retaining bar is moved into clamping engagement with the seal bead sequentially along the length of the retaining assembly at preselected spaced locations, thereby to provide an effective seal between the retainer assembly and the associated seal bead along the entire length of the gap at each side of the gap.

To remove a seal member which requires replacement, it is necessary only to reverse the steps in its installation to release the retainer bar from clamping engagement with the bead, to remove a seal member to be replaced, and thereafter to substitute and install a new seal member in the manner just described.

BRIEF DESCRIPTION OF THE DRAWINGS

Further objects, features and advantages will become apparent from the following description and drawings, of which.

DESCRIPTION OF THE PREFERRED EMBODIMENTS

Figure 7:
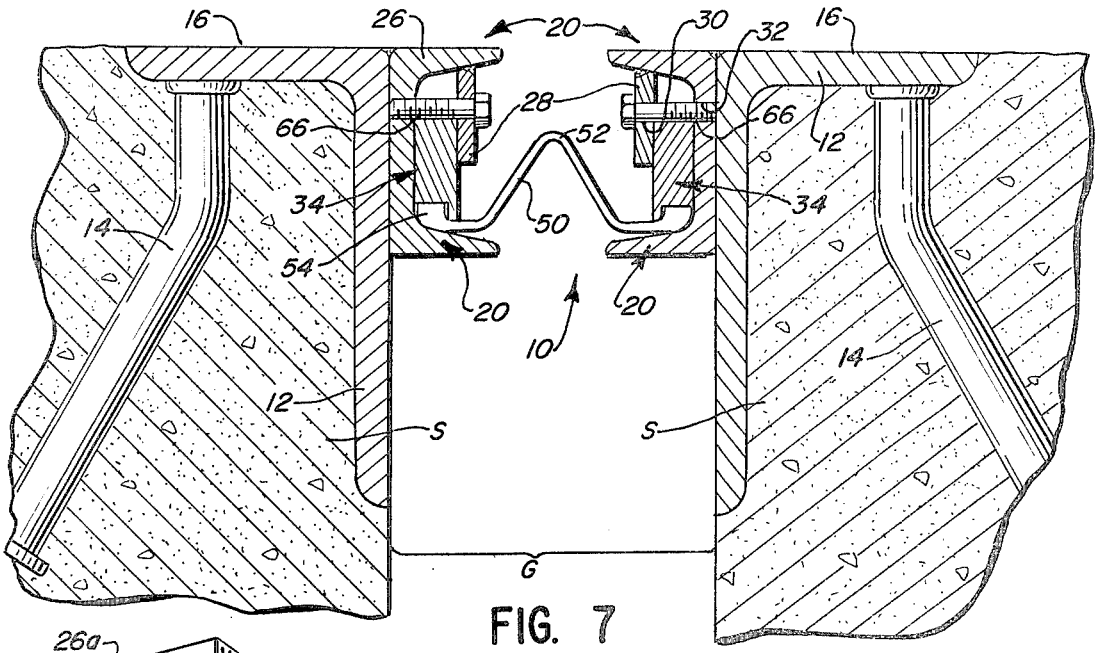
FIG. 7 is an enlarged cross-sectional view of the expansion joint sealing system of FIG. 1 as installed.

Referring now to the drawings, and particularly to FIGS. 1 to 7, inclusive, one expansion joint sealing system 10 of this invention for sealing a roadway gap is seen to incorporate an anchorage system, which may comprise cast-in-place shapes, such as angles 12, having suitable stabilizing connectors and anchors 14 (FIG. 7). Anchors 14 are adapted to be embedded in the concrete forming the spaced-apart roadway slabs S. Slabs S define the elongated gap G to be sealed. The upper legs of angles 12 provide a horizontally disposed portion 16 defining an upper roadway surface.

Figure 1:
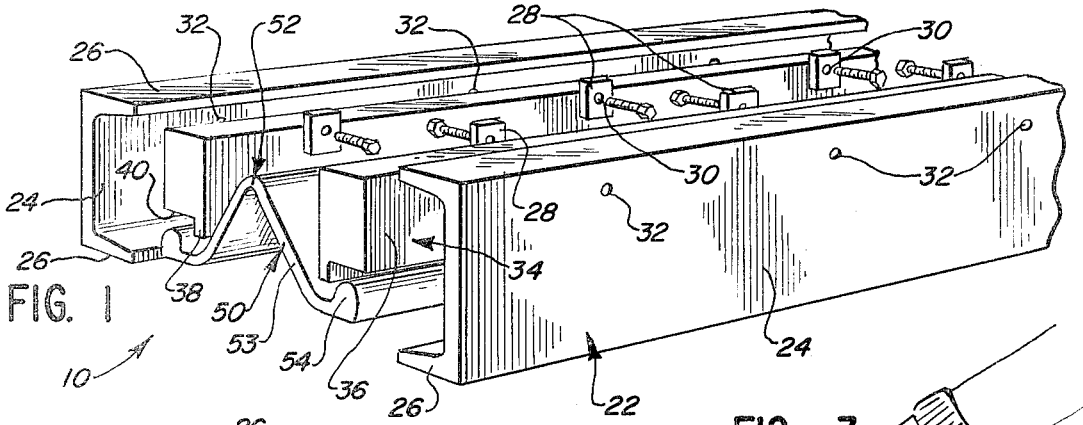
FIG. 1 is an exploded fragmentary perspective view of an expansion joint sealing system of this invention.

Sealing system 10 also incorporates elongate retaining assemblies 20, one at each side of the gap. Assemblies 20 may extend lengthwise of the gap along the entire length of the gap to be sealed, depending upon its length, or may be sectional and adapted to be secured in place in an end-to-end array. Assemblies 20 comprise elongated forms, such as U-shaped channels 22, having a vertically disposed main web 24 and legs 26. Channels 22 mount longitudinally spaced, vertically oriented, retainer plates 28 which are preferably connected, as by welding, to the upper leg 26. In FIG. 1, the plates 28 are shown in exploded view. The retainer plates 28 define apertures 30 which are in line with apertures 32 provided in web 24 for a purpose to be described. The plates 28 and web 24 serve to slidably mount and guide a retainer bar 34 for sliding movement between a first upper position and a second lower clamping position.

The retainer assemblies 20 further comprise a retainer member, such as a retainer bar 34. The retainer bar may be formed or machined from a single bar, such as of steel, and defines a main body 36, a downwardly projecting keeper portion 38 and a sealing surface 40. Alternatively, bars 34 may be formed of a pair of bars or shapes, as by welding.

Figure 2:
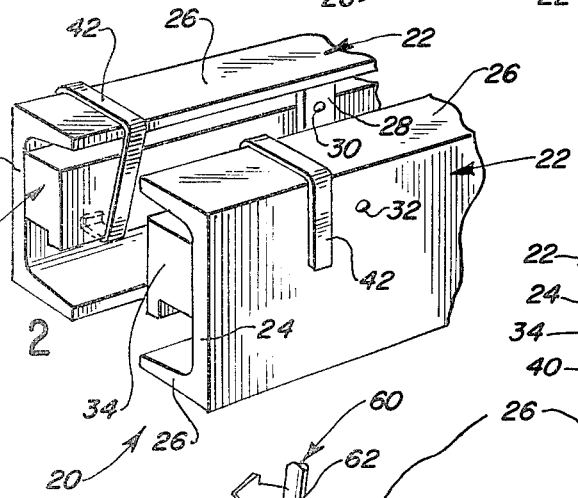
FIG. 2 is an enlarged view of a portion of the sealing system of FIG. 1, conditioned for shipment.

As shown in FIG. 2, retainer bars 34 are adapted to be held in place, as by bent, removable straps 42, to channel 20 for shipment of the retainer assemblies to a site at which they are to be utilized.

Figure 3:
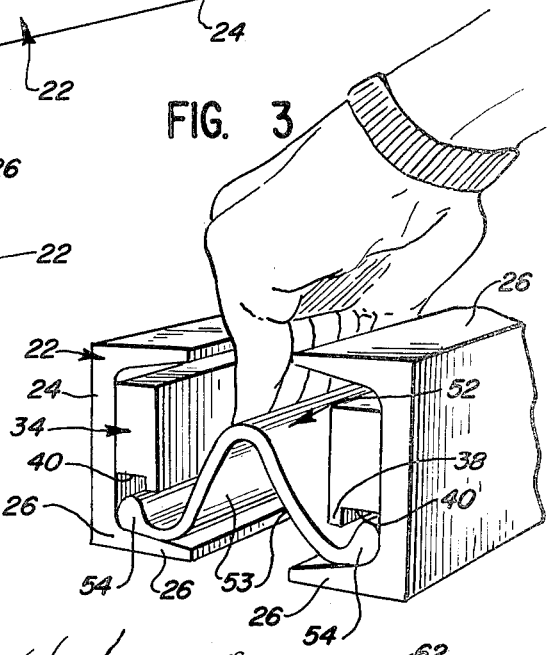
FIG. 3 is a fragmentary perspective view of the sealing system of FIG. 1.
Figure 4:
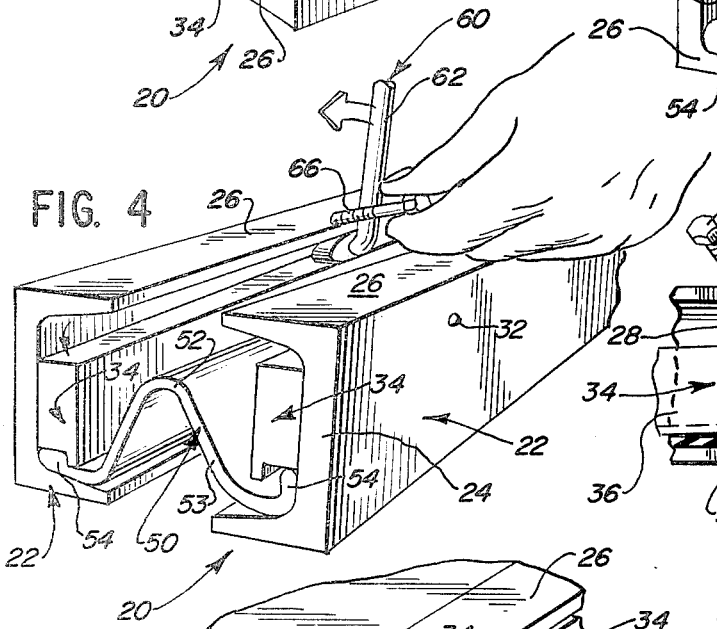
FIG. 4 is a fragmentary perspective view illustrating a mode of assembling the sealing system of FIG. 1.

As shown in FIGS. 1, 3, and 4, the retainer assemblies 20 are adapted to sealingly mount an elastomeric gland or seal 50 to bridge the gap G. Seal 50 is preferably continuous and desirably may be molded. The seal may be provided with reinforcing material in its main body to strengthen it and is desirably made in accordance with U.S. Pat. No. 4,111,583. Seal 50 is molded of neoprene rubber, although it may be extruded as well. Seal 50 comprises a central arched main body portion 52 which may comprise a pair of legs 53 which diverge downwardly. Each leg terminates at its side in a bead-like protrusion such as a foot or bead 54 that projects upwardly. Beads 54 are designed to be clamped between the lower surface of bars 34 and a channel leg 26 and are configured to cooperate with the retainer bars 34 and lower legs 26 to seal a gap G.

Use of the sealing system of this invention first requires the installation of the retaining assemblies 20. To this end, channels 22 are secured to the angles 12. This may be accomplished by welding. Preferably the upper surfaces of the upper legs 26 are positioned to be a continuation of the roadway surface provided by the upper surface 16 of the horizontal legs of angles 12. However, the retaining assemblies may also be positioned below the roadway surface so that the upper legs are downwardly spaced and remote from the roadway surface.

After the retaining assemblies 20 are secured in position (with the straps 42 having previously been removed), the seal element 50 is installed and positioned as illustrated in FIG. 3. The beads 54 are positioned to underlie sealing surfaces 40 and beads 54 are proportioned so that they will be retained by keeper portions 38, generally as illustrated in FIGS. 3, 4, and 7, and generally in the manner described in U.S. Pat. No. 4,111,583.

Figure 5:
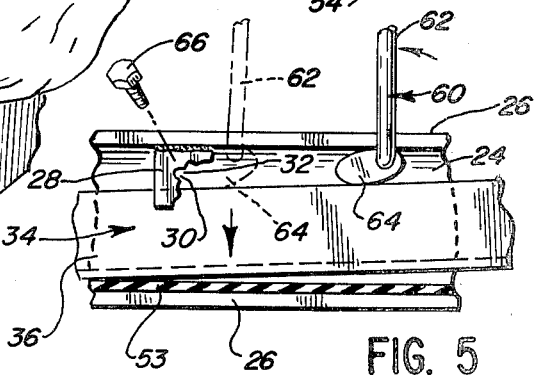
FIG. 5 is a side elevational view, partially in section, showing the mode of assembling the sealing system of FIG. 4.
Figure 6:
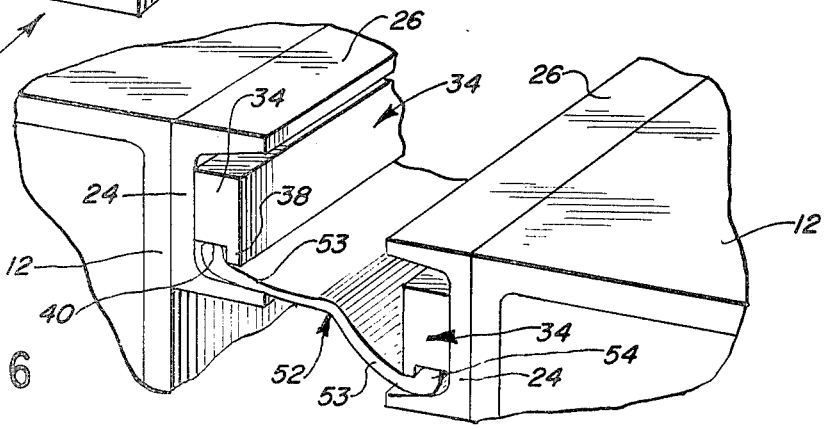
FIG. 6 is a schematic view showing the expansion joint sealing system of FIG. 1 under traffic loading.

To effect the seal to be provided by the retainer bars 34, a loading tool, such as tool 60, is positioned beneath the upper leg 26 and against the upper surface of the retainer bar 34, (and preferably behind a retainer plate 28, thereby to help maintain the tool in position in use), as illustrated in dotted line in FIG. 5, and as shown in FIG. 4. The tool has a handle portion 62 and a cam or eccentric portion 64 so that when the handle is rotated, as in a counterclockwise direction, it will bear and act against the upper surface of the bar 34 and the lower surface of upper leg 26 and will force the retainer bar 34 downwardly into tight engagement with the bead 54, and with the keeper portion 38 in contact with the portion of the seal leg adjacent the bead 54. Other tools than tool 60 may also be used.

When the retainer bar 34 is thus moved downwardly from its first upper position, the aperture 30 in the adjacent retainer plate 28 will lie above the upper surface of the retainer bar and to permit a retaining means or keeper means such as an elongate keeper pin or bolt 66 to be inserted through the aperture 30 and into the aperture 32 in the channel 22. If the apertures are threaded, the bolt will be inserted by rotating it appropriately. After the bolt 66 has been positioned, the tool 60 is moved to its inactive position. At that time, the retainer bar 34 will move back towards its first position until it bears against the central portion of bolt, at which time the bolt 66 will be in double shear. At that position, the retainer bar serves to clampingly compress the bead to the predetermined and desired extent. The tool may then be moved to an adjacent or further retainer plate 28 at which time a bolt 66 is to be passed through aligned apertures 30 and 32 thereat.

After the retainer bars 34 have been fully loaded downwardly in this manner, the beads 54 will be compressed to a predetermined and desired extent, generally as illustrated in the drawings, and in a manner which will effect a seal at the bead 54, thereby to prevent the passage of water, chemicals and debris downwardly through the gap G.

The retainer plates 28 are preferably spaced closely enough together to provide an effective distribution of loading forces along the bead 54, thereby to provide a good seal between the sealing surface 40 of the retaining bar 34 and the underlying bead 54. To minimize interference between the retainer plates 28 on one retainer assembly 20 and the confronting retainer assembly 20 when the gap closes, the retainer plates are preferably staggered or offset on opposite sides.

Figure 8:
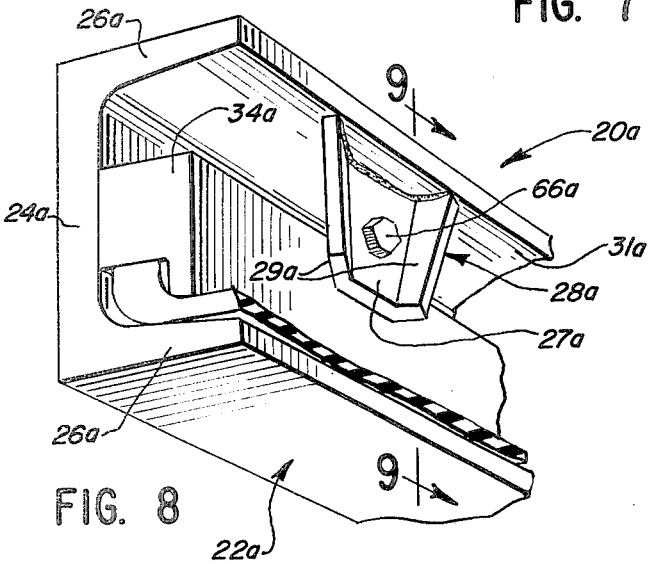
FIGS. 8 and 9 illustrate a further embodiment of a sealing system of this invention.
Figure 9:
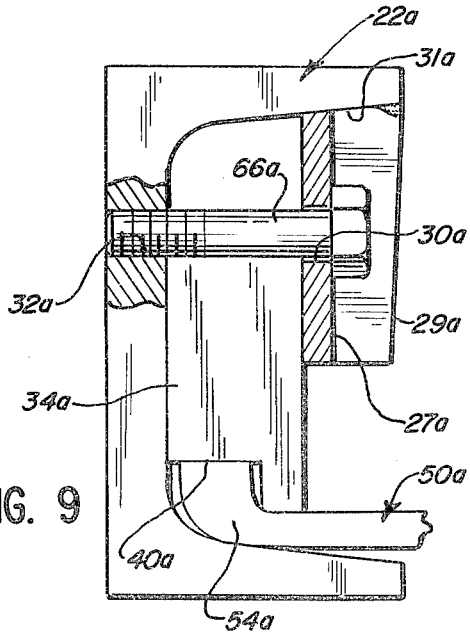

Referring now to FIGS. 8 and 9, a further embodiment of a retainer assembly **20*a* for use in accordance with this invention is there illustrated. As there shown, a suitable form, such as a U-shaped channel 22*a* is provided. Channel 22*a* has a vertically oriented main web 24*a* and legs 26*a*. The channel mounts guide and retainer plates 28*a* which are connected as by welding to the upper leg 26*a*. Each retainer plate defines an aperture 30*a* through which a bolt 66*a* is adapted to be inserted into an aligned, mating aperture 32*a* in web 24*a*. Aperture 32*a* may be threaded in the same manner in which aperture 32** was threaded.

In the embodiment of FIGS. 8 and 9 retainer plate **28*a* comprises a main body 27*a* and two inclined legs 29*a*. Retainer plate 28*a* may be formed from a sheet of steel, as by appropriately bending it to the configuration shown in FIG. 8. The upper surfaces of legs 29*a*, when retainer plate 28*a* is formed, may be at an angle complementary to the lower surface 31*a* of upper leg 26*a* thereby to provide a mating surface for ease of welding and securance of the retainer plate 28*a* thereto. Retainer plates 28*a*** provide enhanced strength.

The retainer plate **28*a* is adapted to guide and retain a retainer bar 34*a* which may be essentially the same as retainer bar 34. Retainer bar 34*a* may be forced downwardly to effect sealing engagement between sealing surface 40*a* and bead 54*a* in the same manner described in connection with the embodiment of FIGS. 1 to 7**.

Figure 10:
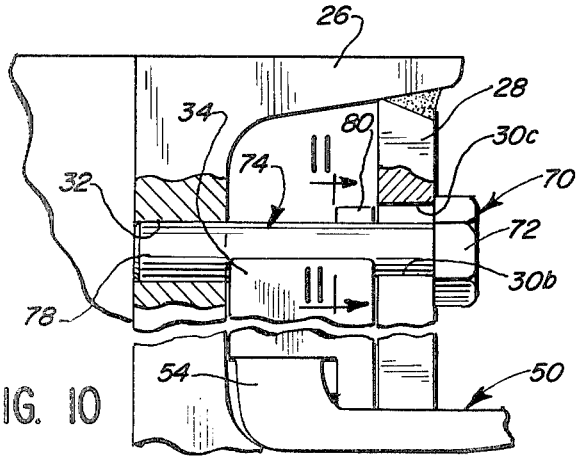
FIGS. 10 and 11 illustrate a further embodiment of a sealing system of this invention.
Figure 11:
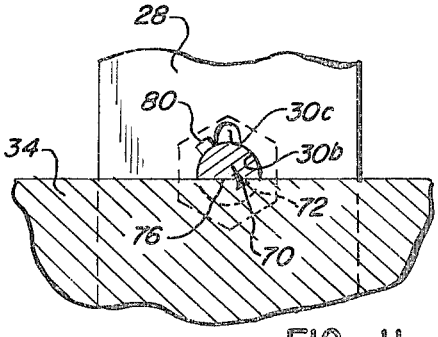

FIGS. 10 and 11 disclose an embodiment similar to that of FIG. 1 and the same part numbers are used. However, in the embodiment of FIGS. 10 and 11 the bolt means or keeper pin is specially configured to interlock with the retaining assemblies.

The bolt or keeper pin 70 comprises an elongate bolt-like member which comprises a head 72 and a shank 74. Shank 74 defines flat central portion 76 which is adapted and proportioned to bear against the upper surface of a retaining bar 34. Shank 74 includes a terminal portion 78 which is received in an aperture 32 in main web 24. Aperture 32 is not threaded. The shank 74 may also mount a locking key 80 which tends to prevent withdrawal of the pin 70.

In this embodiment retainer plate 28 defines an aperture **30*b*. Aperture 30*b* is generally circular and defines an upper keyway portion 30*c* through which a key 80 on the shank is adapted to pass. When the retainer bar is forced downwardly, as by a tool 60, the keeper pin 70 is moved inwardly (to the left as shown in FIG. 10) with the key 80 passing through the keyway 30*c* and then sufficiently far so that the terminal portion 78 of the shank is received in aperture 32**.

The pin is then rotated to position the flattened, central portion 76 in a horizontal position and with the key 80 offset from keyway portion **30*c*. The tool is then moved towards its inactive position and the retainer bar 34 is allowed to move upwardly to bear against the flattened portion 76, at which time the key 80 is positioned immediately behind the retainer plate 28. The flat and key prevent removal of the keeper pin 70** until such time as the retainer bar is purposefully moved downwardly to allow removal of the keeper pin.

It will be apparent that the key 80 may be used on a keeper pin 70 which does not incorporate the flat central portion 76 since it will itself tend to restrain removal of the keeper pin 70. Alternatively, that flat portion 76 may be used without a key 80 to prevent inadvertent removal of the keeper pin 70.

In each embodiment an effective seal will be provided between the retainer bar, the seal and the channel to prevent the passage of water and chemicals past the areas where the seal contacts the bar and channel and through the gap.

Although only several embodiments of this invention have been described it will be apparent that modifications may readily be made without departing from the spirit and scope of the invention. Accordingly, the invention is to be considered as being limited only in accordance with the claims.

What is claimed is:

1. A method of sealing an expansion joint comprising the steps of providing spaced elongate retaining assemblies extending lengthwise of the joint, one at each side of the joint, each retaining assembly comprising a form and a retainer bar slidably mounted on said form for slidable movement vertically from a first position to a second clamping position, positioning a seal member with a seal portion disposed between said retainer bar and a portion of said form at each side of the joint, forcing said retainer bar in the direction of and beyond said second position toward said form portion to compress said seal portion therebetween, positioning a keeper means to overlie said retainer bar, then releasing said retainer bar so that it moves back towards said first position to bear against said keeper means, thereby to clampingly compress said seal portion to a predetermined extent, and repeating said forcing and positioning steps at each side of said joint until said retainer bar clampingly engages said seal portion along the entire length of said retaining assembly.

2. A method of sealing an expansion joint in accordance with claim 1 in which said form comprises a U-shaped channel and said assembly includes a retainer plate slidably mounting said retainer bar between said plate and the web of said channel, and in which said keeper means is a keeper pin and in which said positioning step comprises inserting keeper pin means in said plate and said web to overlie said retainer bar.

3. A method of sealing an expansion joint in accordance with claim 2 in which said seal portion comprises a bead which is compressed between said retainer bar and a leg of said channel.

4. A method of sealing an expansion joint in accordance with claim 3 in which said bead is clampingly compressed between a lower surface of said retainer bar and the lower leg of said channel.

5. A method of sealing an expansion joint in accordance with claim 1 in which said form is a U-shaped channel and in which said assembly comprises a retainer plate slidably mounting said retainer bar between said plate and the web of said channel, and wherein said seal portion comprises a bead to be compressed between said retainer bar and a leg of said channel, said seal being positioned with said bead portions being disposed between a retainer bar and a said leg at each side of the expansion joint, then positioning a tool to bear against the other leg of said channel and against the retainer bar, then, with said tool acting against said other leg and said retainer bar, forcing said retainer bar in the direction of said second position toward the first leg to compress said bead prior to positioning said keeper means.

6. A method of sealing an expansion joint in accordance with claim 5 in which said tool is also positioned between said web and a said retainer plate to help maintain said tool in position as it is moved to act against said other leg and retainer bar to force the retainer bar in the direction of said second position.

7. A method of sealing in accordance with claim 1 in which said form comprises a retainer plate secured thereto for slidably guiding said retainer bar for movement to said second position, and in which said retainer plate and said form define aligned apertures, and in which said positioning step comprises inserting said keeper means through said aligned apertures to overlie said retainer bar so that when it is released it places said keeper means in double shear.

8. A method in accordance with claim 7 in which said keeper means is a bolt having a threaded shank, and in which said positioning step comprises threading said bolt into engagement with said form.

9. A method in accordance with claim 7 in which said keeper means is a bolt having a flattened shank position, and in which said positioning step comprises disposing said flattened portion over said retainer bar to interlock them.

10. A method in accordance with claim 7 in which said keeper means is a bolt having a key thereon, and in which said positioning step comprises disposing said key behind said retainer plate to prevent withdrawal of said bolt.

11. A sealing apparatus for sealing an expansion joint comprising a pair of spaced elongate retaining assemblies extending lengthwise of said joint, one secured at each side of said joint, each said assembly comprising a form and a retainer bar slidably mounted on said form for slidable movement vertically from a first position to a second clamping position, a seal member bridging the space between said assemblies and providing a seal portion positioned between a portion of said form and said retainer bar at each side of the joint, means for retaining each said retainer bar in said second position to clamp a said seal portion between said retainer bar and a said form portion, and in which said retainer means comprises a retainer plate means on said form for slidably mounting said retainer bar, said retaining means further comprising an elongate member overlying said retainer bar for retaining said retaining bar in said second position, and means associated with said form and retainer plate for holding said elongate member in said overlying position, said form comprising a generally U-shaped channel having a main web and a pair of legs and said retainer plate being secured to a leg of said channel, and wherein each of the channel main web and said retainer plate define aligned apertures for receiving and holding said elongate member in said overlying position.

12. A sealing apparatus for sealing an expansion joint in accordance with claim 11 in which said channel is oriented with the channel web in a vertical position and with said retainer plate secured to the upper leg of said channel and generally vertically oriented, thereby to slidably recieve and mount said retainer bar between them, and wherein said elongate member comprises an elongate keeper pin disposed in aligned apertures in said web and retainer plate, with a central portion of said keeper pin overlying and bearing against said retainer bar to maintain said retainer bar in clamping engagement with said seal member to sealingly compress said seal member between said retainer bar and the lower leg of said channel.

13. A sealing apparatus for sealing an expansion joint comprising a pair of elongate retaining assemblies extending lengthwise of a joint, each adapted to be secured at one side of said joint and confronting the other, said assemblies each comprising a form having a main body and legs and a retainer bar slidably positioned for movement vertically on said form to a clamping position, a seal member clampingly secured between a retainer bar and a leg of each of said retaining assemblies, and means for retaining said retainer bar in said clamping position, said retaining means comprising elongate bolt means bearing against said retainer bar and plate means secured to a said leg and aligned apertures defined by said plate means and main body, and wherein said elongate bolt means extends through said apertures to overlie said retainer bar and to be acted on in double shear, thereby to retain said retainer bar in said clamping position.

14. A sealing apparatus for sealing an expansion joint in accordance with claim 13 in which said bolt means includes means to interlock with a retaining assembly.

15. A sealing apparatus for sealing an expansion joint in accordance with claim 9 in which said bolt means defines a flattened shank portion which is adapted to bear against said retainer bar, thereby to interlock with the retaining assembly.

* * * * *

UNITED STATES PATENT OFFICE

CERTIFICATE OF CORRECTION

Patent No. 4,245,925 Dated Jan. 20, 1981

Inventor(s) Lawrence F. Pyle

It is certified that error appears in the above-identified patent and that said Letters Patent are hereby corrected as shown below:

Claim 15, line 2 thereof, change "claim 9" to

-- claim 14 --;

Signed and Sealed this

*Nineteenth* Day of *May 1981*

[SEAL]

*Attest:*

RENE D. TEGTMEYER

*Attesting Officer*

*Acting Commissioner of Patents and Trademarks*